US009960499B2

(12) United States Patent
Liu et al.

(10) Patent No.: US 9,960,499 B2
(45) Date of Patent: May 1, 2018

(54) ANTENNA DEVICE

(71) Applicant: Wistron NeWeb Corp., Hsinchu (TW)

(72) Inventors: An-Shyi Liu, Hsinchu (TW); Chung-Han Hsieh, Hsinchu (TW); Tsun-Che Huang, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days. days.

(21) Appl. No.: 15/143,903

(22) Filed: May 2, 2016

(65) Prior Publication Data

US 2016/0380361 A1 Dec. 29, 2016

(30) Foreign Application Priority Data

Jun. 29, 2015 (TW) ..... 104120901 A

(51) Int. Cl.

| | |
|---|---|
| ***H01Q 21/00*** | (2006.01) |
| ***H01Q 21/06*** | (2006.01) |
| ***H01Q 9/06*** | (2006.01) |
| ***H01Q 5/371*** | (2015.01) |

(52) U.S. Cl.

CPC ..... *H01Q 21/062* (2013.01); *H01Q 5/371* (2015.01); *H01Q 9/065* (2013.01)

(58) Field of Classification Search

None

See application file for complete search history.

(56) References Cited

U.S. PATENT DOCUMENTS

| | | | | |
|---|---|---|---|---|
| 6,621,464 | B1 * | 9/2003 | Fang | H01Q 9/28 343/793 |
| 7,511,680 | B2 * | 3/2009 | Shtrom | H01Q 3/24 343/795 |
| 7,724,201 | B2 * | 5/2010 | Nysen | H01Q 1/2275 343/700 MS |
| 2004/0222936 | A1 * | 11/2004 | Hung | H01Q 1/38 343/795 |
| 2008/0174505 | A1 * | 7/2008 | Wong | H01Q 9/285 343/795 |
| 2009/0128439 | A1 * | 5/2009 | Su | H01Q 1/243 343/795 |
| 2009/0284430 | A1 * | 11/2009 | Liu | H01Q 9/285 343/810 |
| 2014/0134958 | A1 | 5/2014 | Sanchez et al. | |

FOREIGN PATENT DOCUMENTS

TW 201507283 A 2/2015

* cited by examiner

*Primary Examiner* — Trinh Dinh

(74) *Attorney, Agent, or Firm* — McClure, Qualey & Rodack, LLP

(57) ABSTRACT

An antenna device includes a first dipole antenna and a second dipole antenna. The polarization direction of the first dipole antenna is a first direction, and the polarization direction of the second dipole antenna is the first direction. Each of the first dipole antenna and the second dipole antenna includes at least one first radiator and at least one second radiator, and there is a notch between the first and second radiators. The notch of the first dipole antenna is towards a second direction, and the notch of the second dipole antenna is toward a third direction that is different from the second direction.

17 Claims, 20 Drawing Sheets

ANTENNA DEVICE

CROSS REFERENCE TO RELATED APPLICATIONS

This Application claims priority of Taiwan Patent Application No. 104120901 filed on Jun. 29, 2015, the entirety of which is incorporated by reference herein.

BACKGROUND OF THE INVENTION

Field of the Invention

The disclosure generally relates to an antenna device, and more particularly, to an antenna device which is composed by utilizing dipole antenna and its array.

Description of the Related Art

Due to the increasing needs and utilization of wireless communication, how to utilize a frequency band efficiently in a limited frequency resource becomes an important issue. Generally, MIMO (Multi-Input Multi-Output System) is a popular system for wireless communication, to transmit and receive wireless signals effectively. However, the transmission and receiving of wireless signals are often affected by the outside environment. For example, when users are in a theater or a large stadium, the positions of the users are not distributed uniformly. The positions of the users are often gathered in a certain height or a certain area. If the MIMO system is not incorporated with a suitable antenna design, power will be wasted and system performance will suffer. Therefore, an antenna with a suitable radiation pattern is needed to meet the needs of the user and environmental conditions, and to improve transmission performance, and the efficiency of using the frequency band.

BRIEF SUMMARY OF THE INVENTION

In order to solve the aforementioned problem, the invention proposes an antenna device to improve the transmission throughput and efficiency of using the frequency band. The antenna device of the present invention can provide a wider radiation bandwidth and a higher antenna gain in certain directions or planes, according to the user's needs and environmental conditions. Therefore, the utilization of the frequency band and the transmission and receiving of signals will become more efficient.

In one aspect of the invention, an antenna device is provided. The antenna device includes a first dipole antenna and a second dipole antenna. The polarization direction of the first dipole antenna is a first direction, and the polarization direction of the second dipole antenna is also the first direction. Each of the first dipole antenna and the second dipole antenna includes at least one first radiator and at least one second radiator, and there is a notch between the first and second radiators. The notch of the first dipole antenna is towards a second direction, and the notch of the second dipole antenna is toward a third direction that is different from the second direction. Each of the first dipole antenna and the second dipole antenna comprises two antenna structures, and each antenna structure comprises the first radiator for implementing signals of a first frequency and a second radiator for implementing signals of a second frequency.

Specifically, the first dipole antenna comprises a first feeding point, the second dipole antenna comprises a second feeding point, and the antenna device connects with a switch device through the first feeding point and the second feeding point to switch and enable the first dipole antenna and the second dipole antenna together. A first terminal of the switch device connects with a RF (radio frequency) device, a second terminal and a third terminal of the switch device connect with the first feeding point and the second feeding point to implement signal transmission between the antenna device and the RF device In another aspect of the invention, an antenna device is provided. The antenna device includes at least one antenna array. Each of the antenna array includes: a first dipole antenna, wherein polarization direction of the first dipole antenna is a first direction; a second dipole antenna whose polarization direction is a second direction; a third dipole antenna whose polarization direction is the first direction; a fourth dipole antenna whose polarization direction is the second direction. Each of the first dipole antenna, the second dipole antenna, the third dipole antenna and the fourth dipole antenna comprises two antenna structures, each antenna structure comprises a first radiator for implementing signals of a first frequency and a second radiator for implementing signals of a second frequency, notch direction of the first dipole antenna is different from notch direction of the third dipole antenna, and notch direction of the second dipole antenna is different from notch direction of the fourth dipole antenna.

BRIEF DESCRIPTION OF DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF THE INVENTION

Figure 1:
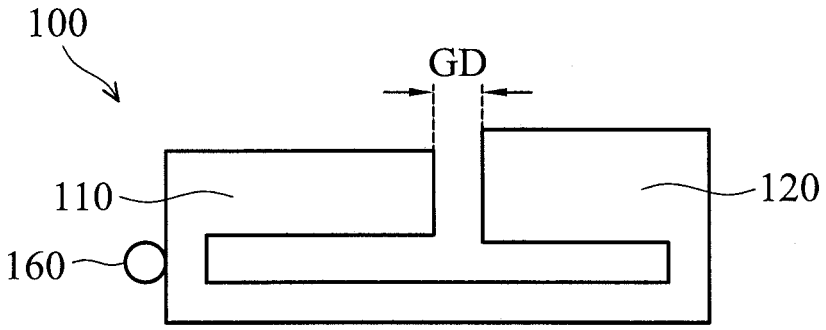
FIG. 1 is a schematic of an antenna structure according to an embodiment of the invention.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a schematic of an antenna structure 100 according to an embodiment of the invention. In one embodiment, the antenna structure 100 is composed of metal material. The antenna structure 100 could be utilized in wireless networking environment of multi-frequency bands, such as the wireless network complying with the 802.11a/b/g/n/ac standards. As shown in FIG. 1, the antenna structure 100 includes two radiators 110 and 120, and there is a notch GD between the two radiators 110 and 120. Specifically, one terminal of the radiator 110 connects with a terminal of the radiator 120. Another terminal of the radiator 110 is separated with another terminal of the radiator 120 by the notch GD without contacting with each other. In addition, the feeding point 160 is arranged on one side of the antenna structure 100. As shown in FIG. 1, the feeding point 160 is on one side of the antenna structure 100 and adjacent to the radiator 110. On the one hand, since the distance between the feeding point 160 and the terminal of the radiator 110 is short (which means the length of the radiator 110 is shorter), it could be utilized to receive or transmit radio signals of higher frequency. On the other hand, since the distance between the feeding point 160 and the terminal of the radiator 120 is long (which means the length of the radiator 120 is longer), it could be utilized to receive or transmit radio signals of lower frequency. For example, the radiator 120 could be utilized to receive or transmit radio signals of frequency of 2.4 GHz to 2.5 GHz (the first frequency), and the radiator 110 could be utilized to receive or transmit radio signals of frequency of 4.9 GHz to 5.95 GHz (the second frequency).

Figure 2A:
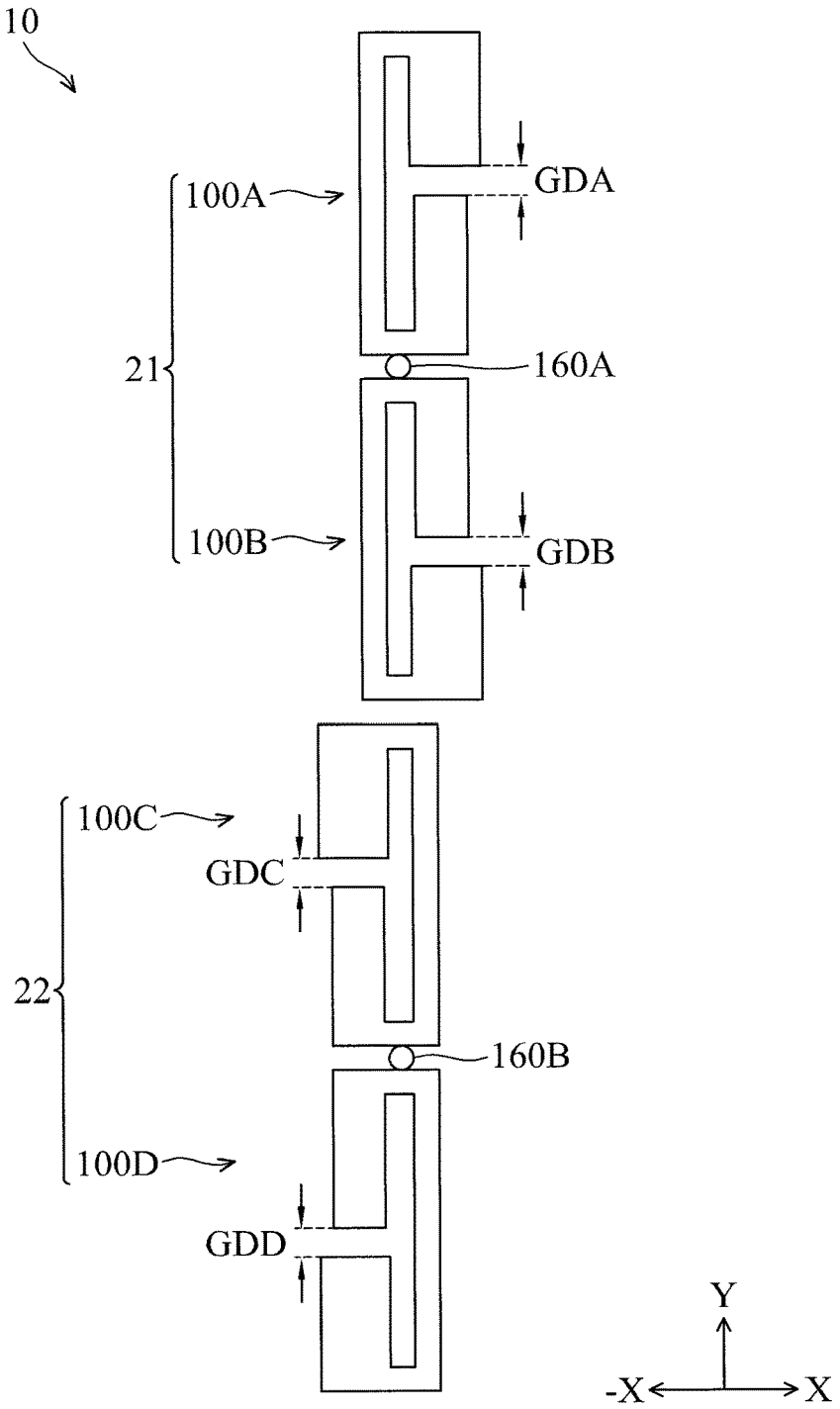
FIG. 2A is a schematic of an antenna device according to an embodiment of the invention.

FIG. 2A is a schematic of an antenna device 10 according to an embodiment of the invention. The antenna device 10 could be utilized in network server, desktop computer, notebook computer, tablet computer, smartphone and/or any device capable of providing wireless network service and network connecting function, and it is not limited thereto. In one embodiment, the antenna device 10 includes two dipole antennas 21 and 22. As shown in FIG. 2A, the dipole antenna 21 includes two antenna structures 100A and 100B, and the dipole antenna 22 includes two antenna structure 100C and 100D. The structures of the antenna structures 100A~100D are the same as the antenna structure 100 of FIG. 1, and it will not be descried again. The dipole antenna 21 includes a feeding point 160A, and the feeding point 160A is arranged between the antenna structures 100A and 100B. The dipole antenna 22 includes a feeding point 160B, and the feeding point 160B is arranged between the antenna structures 100C and 100D. The antenna device 10 connects with a switch device through the feeding points 160A and 160B to switch and enable the dipole antennas 21 and 22. For example, when the dipole antenna 21 is switched and enabled, it means that the dipole antenna 21 is utilized by the antenna device 10 to receive and transmit wireless signals.

It should be noted that the dipole antennas 21 and 22 have the same polarization direction. In the embodiment of FIG. 2A, the polarization directions of dipole antennas 21 and 22 are the direction of Y axis. In other words, the antenna structures 100A and 100B of the dipole antenna 21 are arranged along the direction of Y axis, and the radiators of the antenna structures 100A and 100B are arranged along the direction of Y axis. The antenna structures 1000 and 100D of the dipole antenna 22 are arranged along the direction of Y axis, and the radiators of the antenna structures 100C and 100D are arranged along the direction of Y axis. However, the notches GDA and GDB of the two antenna structures 100A and 100B of the dipole antenna 21 are toward the X-axis direction, and the notches GDC and GDD of the two antenna structures 100C and 100D of the dipole antenna 22 are toward the direction opposite to X-axis direction (i.e., −X axis direction). In other words, the notch direction of the dipole antenna 21 is different from the notch direction of the dipole antenna 22. In this embodiment, the notch direction of the dipole antenna 21 is vertical to the polarization direction of the dipole antenna 21, the notch direction of the dipole antenna 22 is vertical to the polarization direction of the dipole antenna 22, and the difference between the notch directions of the dipole antenna 21 and dipole antenna 22 is 180 degrees.

Since the polarization directions of the dipole antennas 21 and 22 are Y-axis direction, a radiation pattern with wider lobe could be provided in the plane (X-Z plane) which is vertical to the polarization direction. It should be noted that lobe means the radiation pattern for the antenna to receive and transmit signals. Generally, when only one antenna structure (such as dipole antenna 21) is provided, the radiation pattern of the antenna will not be perfectly symmetric and will incline toward certain direction. When two antenna structures (such as the dipole antennas 21 and 22) are provided and their notch directions are different, the overall synergy of the antenna device 10 could be achieved for obtaining complete and symmetric radiation pattern. Therefore, the antenna device 10 of the present invention could provide complete and symmetric radiation pattern, and wide lobe in a certain plane according to the needs of the user and the environment.

Figure 2B:
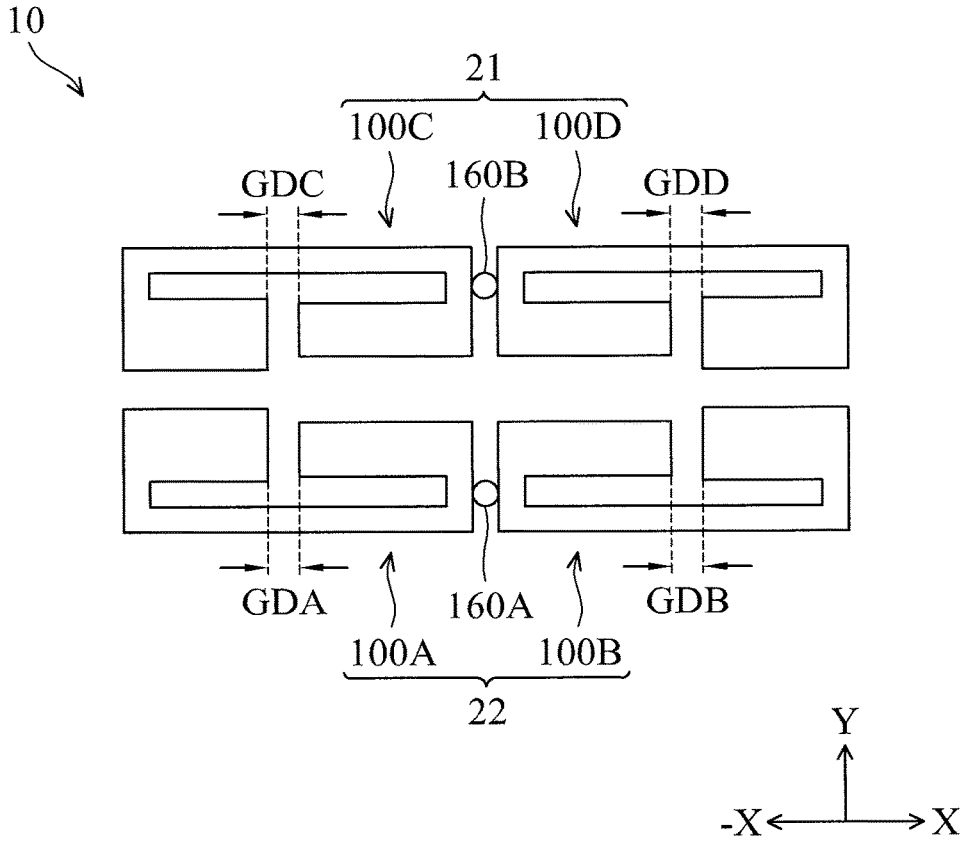
FIG. 2B and FIG. 2C are schematics of antenna devices according to other embodiments of the invention.

FIG. 2B is another schematic of antenna device 10 according to other embodiments of the invention. The dipole antennas 21 and 22 are arranged along the Y-axis direction, but their polarization directions are X-axis direction. In other words, the radiators of the antenna structures 100A~100D are arranged parallel to the X-axis direction. In addition, the notch directions GDA and GDB of the dipole antenna 22 are toward the Y-axis direction, and the notch directions GDC and GDD of the dipole antenna 21 are toward the direction opposite to the Y-axis direction. Therefore, the antenna device 10 of FIG. 2B could provide radiation pattern of wide frequency band in the plane parallel to the Y axis. It should be noted that the two antenna structures of the dipole antenna 21 or 22 could be arranged asymmetrically. In other words, the two radiators included by the dipole antennas 21 and 22 could be different lengths or widths, and is not limited by the present invention.

Figure 2C:
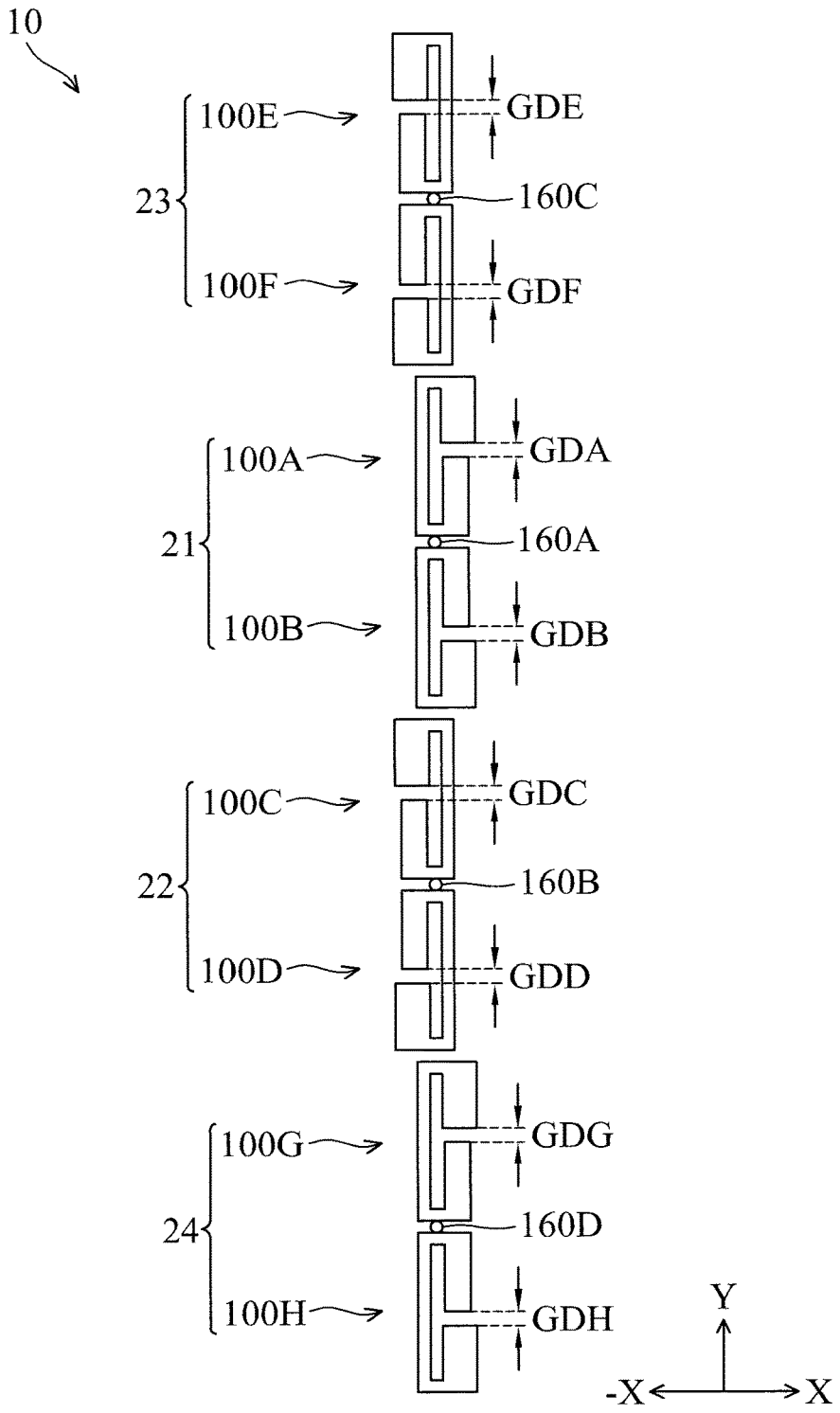

FIG. 2C is another schematic of antenna device 10 according to other embodiments of the invention. The antenna device 10 of FIG. 2C is the extension and amendment of the antenna device of FIG. 2A. Compared with the embodiment of FIG. 2A, the antenna device 10 of FIG. 2C further includes the dipole antennas 23 and 24, and structures of the dipole antennas 23 and 24 are the same as the dipole antennas 21 and 22. The polarization directions of the dipole antennas 21~24 are Y-axis direction. The dipole antennas 21 and 22 are arranged between the dipole antennas 23 and 24. The notch direction of the dipole antenna 23 is toward the direction opposite to the X-axis direction, and the notch direction of the dipole antenna 24 is toward the X-axis direction. Because the antenna device 10 includes four antenna structures 21~24, higher antenna gain could be provided. Furthermore, regarding any two adjacent antenna structures of the antenna structures 21~24, their notch directions are different. Therefore, a complete radiation pattern and wide frequency band could be provided in a specific direction or plane.

Figure 3:
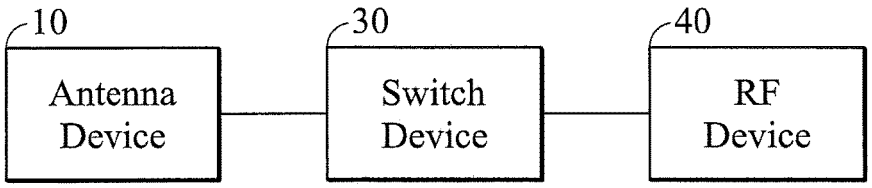
FIG. 3 is a schematic of an antenna device, a switch device and a RF device according to another embodiment of the invention.

FIG. 3 is a schematic of an antenna device 10, a switch device 30 and a RF device 40 according to another embodiment of the invention. As illustrated before, the antenna device 10 includes a plurality of dipole antennas, and each dipole antenna includes a feeding point. The switch device 30 is coupled between the antenna device 10 and the RF device 40. In one embodiment, the switch device 30 connects with a plurality of feeding points of the antenna device 10 and connects with the RF device 40. The switch device 30 is utilized to transmit wireless signals between the antenna device 10 and the RF device 40. Specifically, one of the polarization directions is selected by the switch device 30 according to the user needs or the environment of the antenna device 10. Accordingly, a plurality of dipole antennas with the polarization direction of X axis or Y axis within the antenna device 10 are selected, switched and enabled, and the switched dipole antennas are utilized to receive or transmit wireless signals. In another embodiment, the antenna device 10 could further includes the switch device 30. The antenna device 10 connects with the switch device 30 through the first feeding point and the second feeding point enable the first dipole antenna and the second dipole antenna together.

Figure 4A:
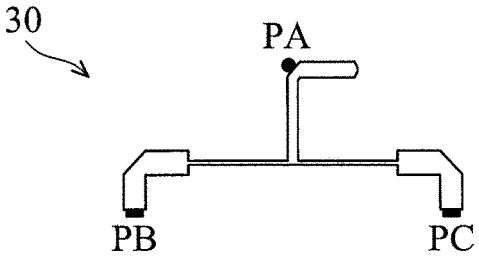
FIG. 4A is a schematic of a switch device according to an embodiment of the invention.
Figure 4B:
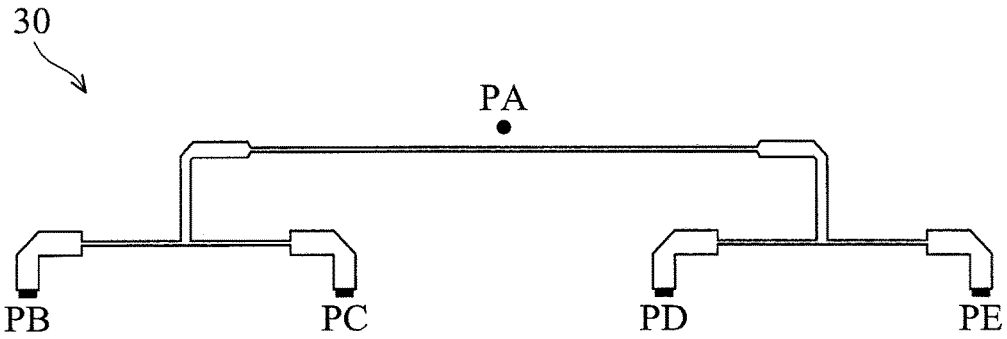
FIG. 4B is a schematic of a switch device according to another embodiment of the invention.

FIG. 4A is a schematic of a switch device 30 according to an embodiment of the invention. For example, the switch device 30 is a one-to-two switch. The terminal PA of the switch device 30 connects with the RF connection port of the RF device 40. The two terminals PB and PC of the switch device 30 connect with the two feeding points of the antenna device 10 respectively (such as the feeding points 160A and 160B of FIG. 2A) to switch and enable dipole antennas 21 and 22 and to perform signal transmission between the antenna device 10 and the RF device 40. FIG. 4B is a schematic of a switch device 30 according to another embodiment of the invention. In this embodiment, the switch device 30 is a one-to-four switch. The terminal PA of the switch device 30 connects with the RF connection port of the RP device 40, and four terminals PB, PC, PD and PE of the switch device 30 connects with the four feeding points of the antenna device 10 (such as four feeding points 160A, 160B, 160C and 160D of FIG. 2C) to connect with the dipole antennas 21~24 and perform signal transmission between the antenna device 10 and the RF device 40. In addition, the switch device 30 could be utilized to convert impedance generated by dipole antennas so that the impedance measured by the RF connection port of the RF device 40 is about 50 ohm.

Figure 5A:
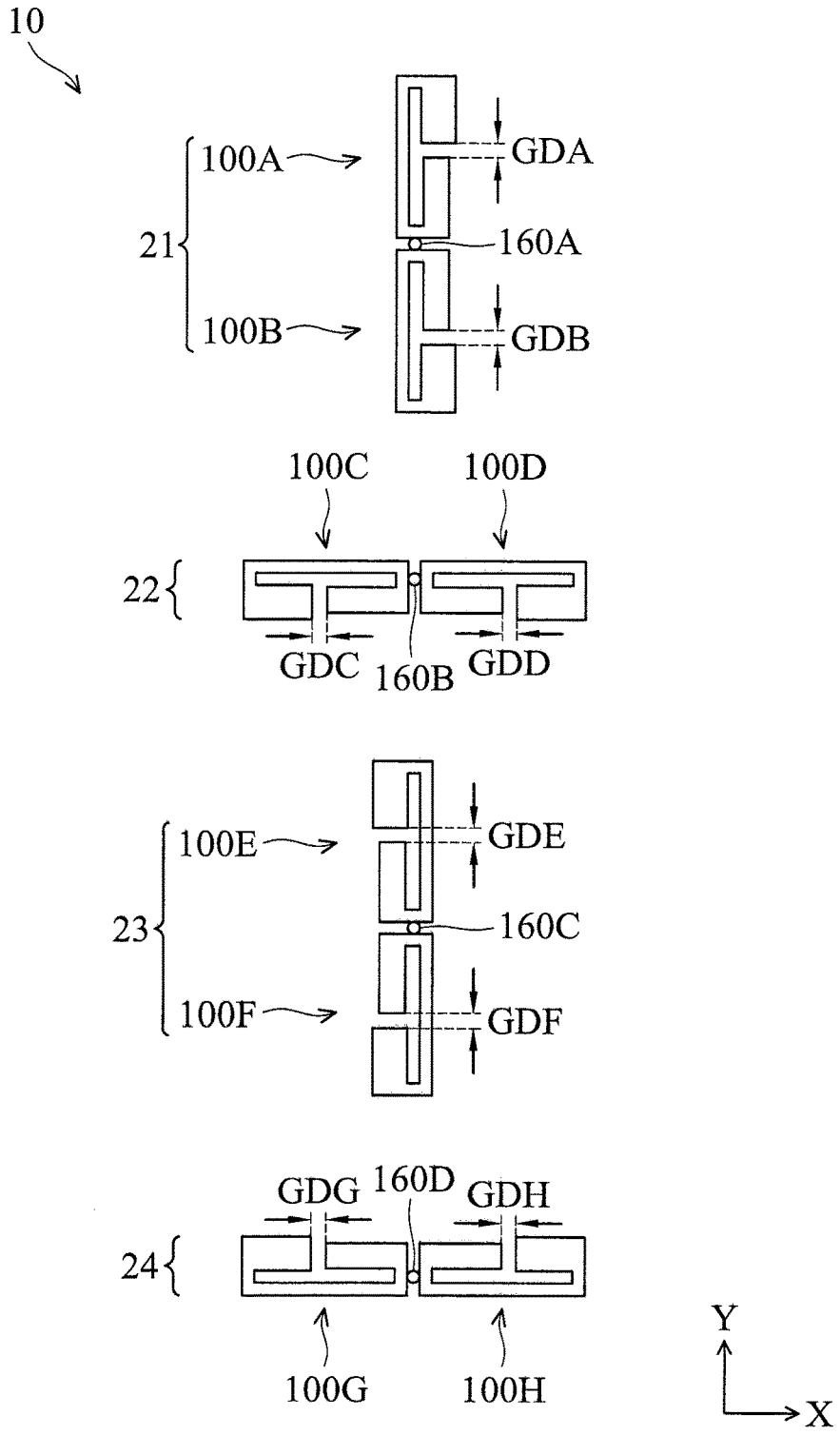
FIG. 5A is a schematic of an antenna device according to an embodiment of the invention.

FIG. 5A is a schematic of an antenna device 10 according to an embodiment of the invention. The antenna device 10 includes four dipole antennas 21~24. The polarization direction of the dipole antennas 21 and 23 is Y-axis direction, and the polarization direction of the dipole antennas 22 and 24 is X-axis direction. Each of the four dipole antennas 21~24 includes two antenna structure, and each antenna structure includes two radiators four implementing two different frequencies respectively. There is a notch between the two radiators. The notch directions of the dipole antennas 21 and 23 are different, and the notch directions of the dipole antennas 22 and 24 are different.

As shown in FIG. 5A, four dipole antennas are arranged along the Y-axis direction. Therefore, the four dipole antennas 21~24 could also become an antenna array. The polarization direction of the dipole antennas 21 and 23 is vertical to the polarization direction of the dipole antennas 22 and 24. In one embodiment, the difference between the notch directions of the dipole antenna 21 and dipole antenna 23 is 180 degree, and the difference between the notch directions of the dipole antenna 22 and dipole antenna 24 is 180 degree. In addition, four dipole antennas 21~24 have feeding points 160A~160D respectively to connect with the switch device 30. The terminal PA of the switch device 30 connects with the RF connection port of the RF device 40, and four terminals PB, PC, PD and PE of the switch device 30 connects with the four feeding points 160A~460D of the antenna device 10 to switch and enable the dipole antennas 21~24 and perform signal transmission between the antenna device 10 and the RF device 40. Because four dipole antennas 21~24 have two different polarization directions and/or has different notch directions, a complete radiation pattern and a wide frequency band could be provided in a specific direction or plane by selecting a group of dipole antennas with the same polarization direction. In one embodiment, the switch device 30 could also switch and enable the dipole antennas 21~24 of two different polarization directions. Therefore, the dipole antennas of different polarization directions could be operated in different frequency bands and could transmit signals with a wireless device. For example, the antenna device 10 is operated based on the 802.11 standard, the dipole antennas 21 and 23 are operated in the first frequency (such as 2.4 GHz), and the dipole antennas 22 and 24 are operated in the second frequency (such as 5 GHz).

Figure 5B:
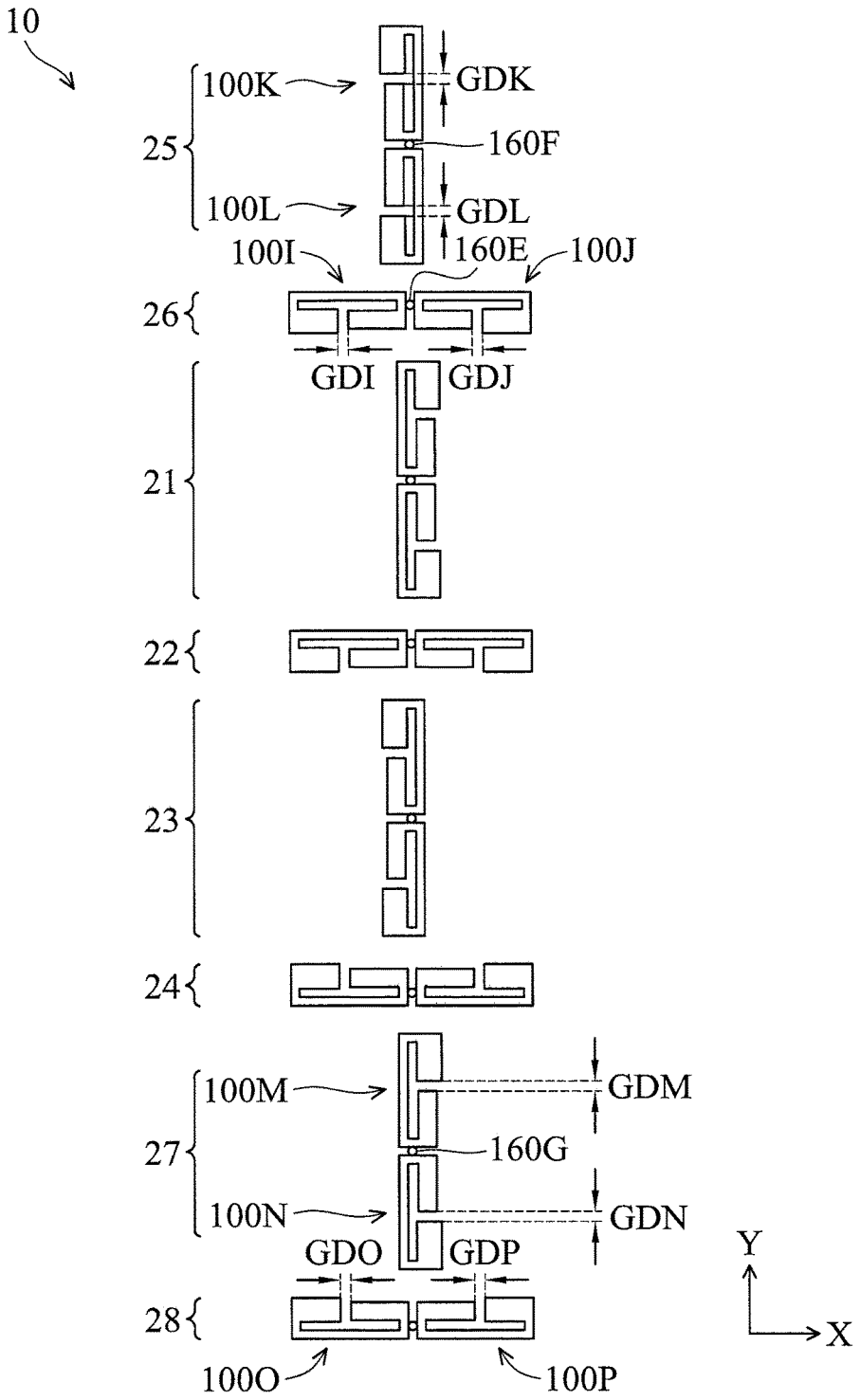
FIG. 5B and FIG. 5C are schematics of antenna devices according to other embodiments of the invention.
Figure 5C:
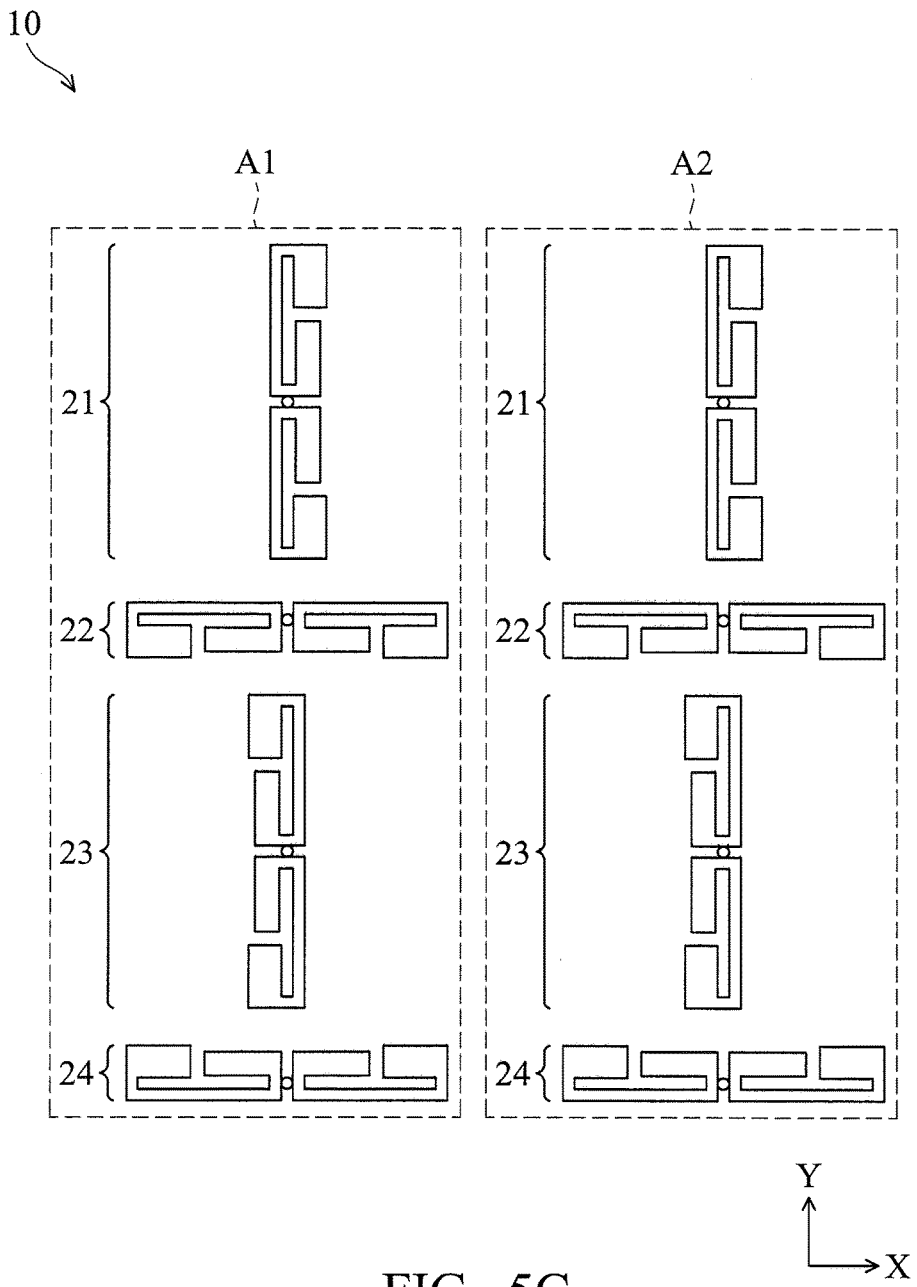

FIG. 5B is another schematic of antenna device 10 according to other embodiments of the invention. The antenna device 10 of FIG. 5B is the extension and amendment of the antenna device of FIG. 5A. Compared with the embodiment of FIG. 5A, the antenna device 10 of FIG. 5B further includes four dipole antennas 25~28 whose structures are the same as the dipole antennas 21~24. The polarization directions of the two dipole antennas 25 and 26 are Y-axis direction and X-axis direction respectively. The dipole antenna 21 is arranged between the dipole antennas 26 and 22, and the dipole antenna 26 is arranged between the dipole antennas 21 and 25. The polarization directions of the two dipole antennas 27 and 28 are Y-axis direction and X-axis direction respectively. The dipole antenna 24 is arranged between the dipole antennas 23 and 27, and the dipole antenna 27 is arranged between the dipole antennas 24 and 28. It should be noted that because the dipole antennas with the same polarization directions having different notch directions, the effect of complete radiation pattern could be obtained accordingly. Specifically, regarding the dipole antennas 21, 23, 25 and 27 of Y-axis polarization direction, their dispositions of notches are interlaced. Regarding the dipole antennas 22, 24, 26 and 28 of X-axis polarization direction, their dispositions of notches are symmetrical. Regarding the antenna device 10 of FIG. 5B, since it has eight antenna structures 21~28, compared to the antenna device 10 of FIG. 5A with four dipole antennas 21~24, higher antenna gain will be obtained to improve the efficiency of transmitting and receiving signals for the antenna device. FIG. 5C is a schematic of an antenna device 10 according to an embodiment of the invention. The antenna device 10 includes two antenna arrays A1 and A2 of same structures, and the two antenna arrays A1 and A2 are arranged along the X-axis direction. For example, the two antenna arrays A1 and A2 could be utilized for a 2×2 MIMO system. The antenna arrays A1 and A2 include four dipole antennas 21~24 whose structures are shown in FIG. 5A, and will not be repeated.

In the embodiment of FIG. 5B, dipole antennas 21~28 have feeding points 160A~160H respectively. Polarization directions of the dipole antennas 21, 23, 25 and 27 are parallel to Y axis to provide similar radiation pattern. The antenna device 10 connects with the switch device 30 through the feeding points 160A, 160C, 160E and 160G of dipole antennas 21, 23, 25 and 27, and it switches and enables any two adjacent dipole antennas of the dipole antennas 21, 23, 25 and 27 to receive and transmit RF signals. In another embodiment, four dipole antennas 21, 23, 25 and 27 are switched and enabled together to receive and transmit RF signals. In addition, polarization directions of the dipole antennas 22, 24, 26 and 28 are parallel to X axis to provide similar radiation pattern. The antenna device 10 connects with the switch device 30 through the feeding points 160B, 160D, 160F and 160H of dipole antennas 22, 24, 26 and 28, and it switches and enables any two adjacent dipole antennas of the dipole antennas 22, 24, 26 and 28 to receive and transmit RF signals. In another embodiment, four dipole antennas 22, 24, 26 and 28 are switched and enabled together to receive and transmit RF signals. In another embodiment, the antenna device 10 connects with two switch devices 30 of one-to-four switching function to switch and enable four dipole antennas 21, 23, 25, 27 and four dipole antennas 22, 24, 26 and 28. In another embodiment, the antenna device 10 connects with a switch device 30 with one-to-eight switching function to switch and enable eight dipole antennas 21~28. The amount and type of the switch device 30 could be adjusted corresponding to the user needs and circuit design, and is not limited by the invention.

Figure 6A:
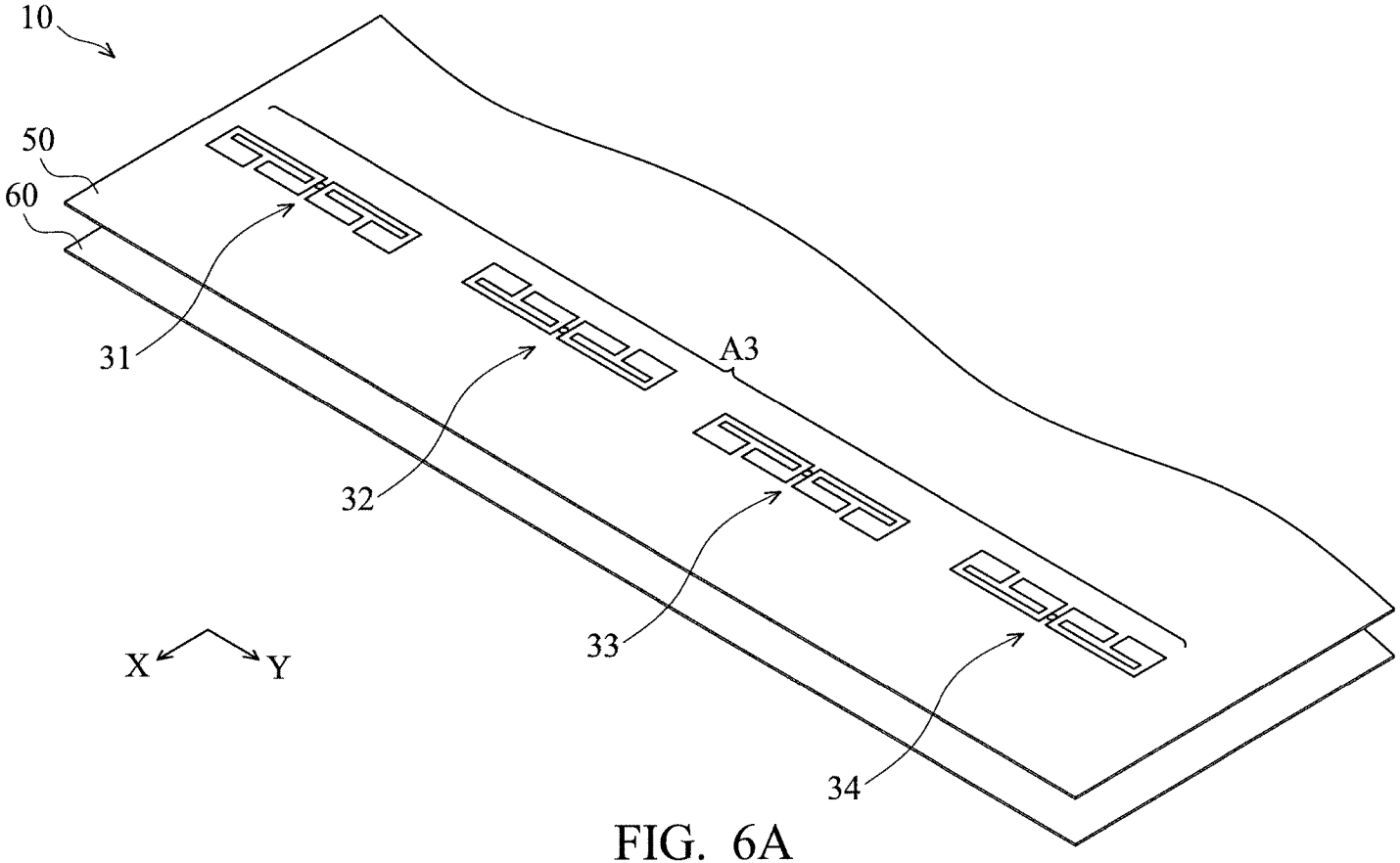
FIG. 6A is a schematic of an antenna device according to an embodiment of the invention.

FIG. 6A is a schematic of the antenna device 10 according to an embodiment of the invention. The antenna device 10 includes an antenna array A3, and the antenna array A3 include four dipole antennas 31~34. The polarization directions of the dipole antennas 31~34 are parallel to Y axis, and the notch directions of the dipole antennas 31 and 33 are toward the same direction as the X axis, and the notch directions of the dipole antennas 32 and 34 are toward the direction opposite to the X axis. The structures of the dipole antennas 31~34 are the same as the dipole antenna 10 of FIG. 1, and will not be illustrated repeatedly. It should be noted that the antenna array is arranged above the circuit board 50, and another circuit board 60 is arranged below the circuit board 50. The circuit board 60 includes a ground layer, and the two circuit boards 50 and 60 are connected with wire structure. In one embodiment, the antenna array A3 is arranged on the first plane of the circuit board 50, and the switch device 30 is arranged on the second plane of the circuit board. The second plane on the contrary to the first plane, and it is toward the circuit board 60.

Figure 6B:
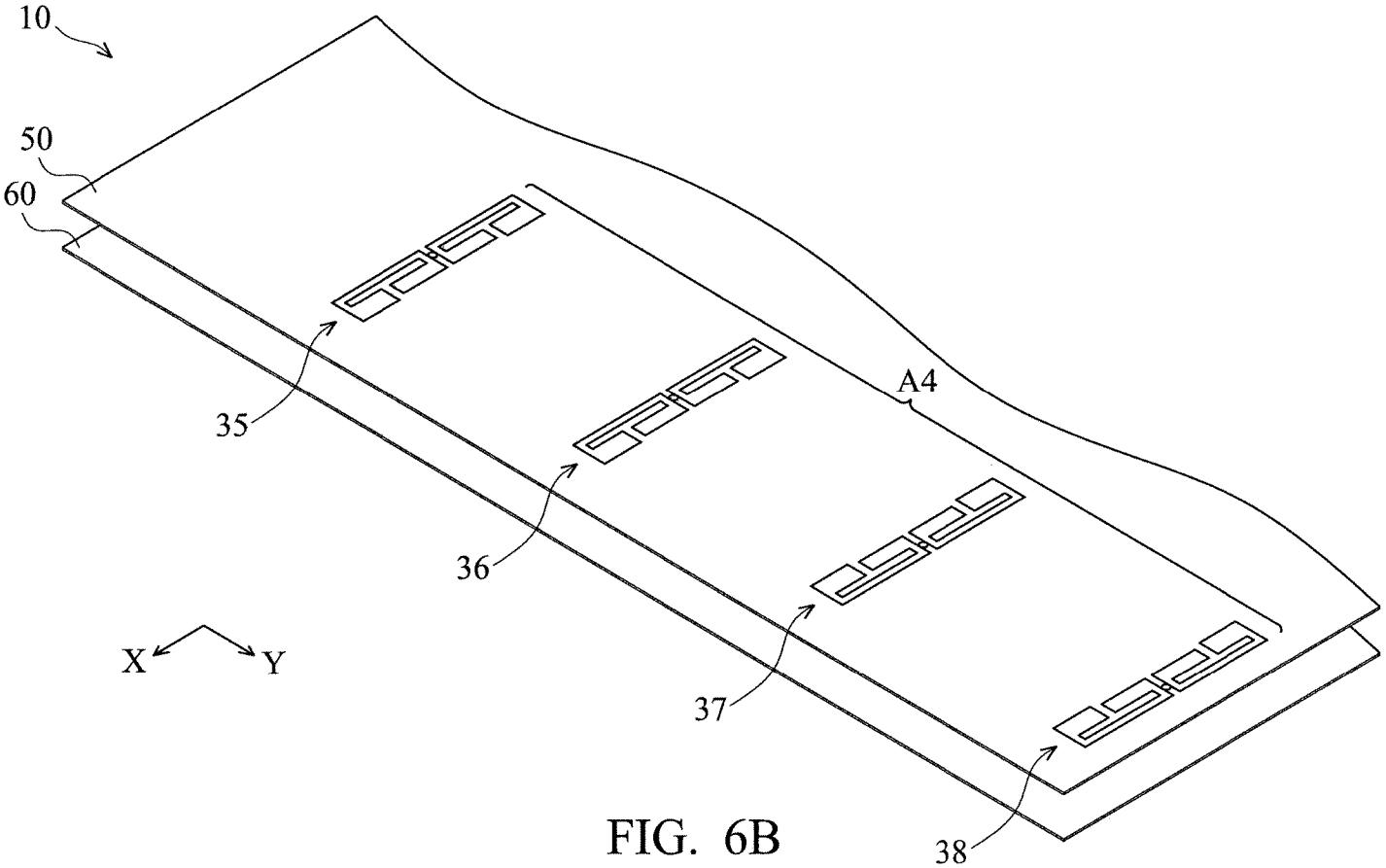
FIG. 6B, FIG. 6C and FIG. 6D are schematics of antenna devices according to other embodiments of the invention.
Figure 6C:
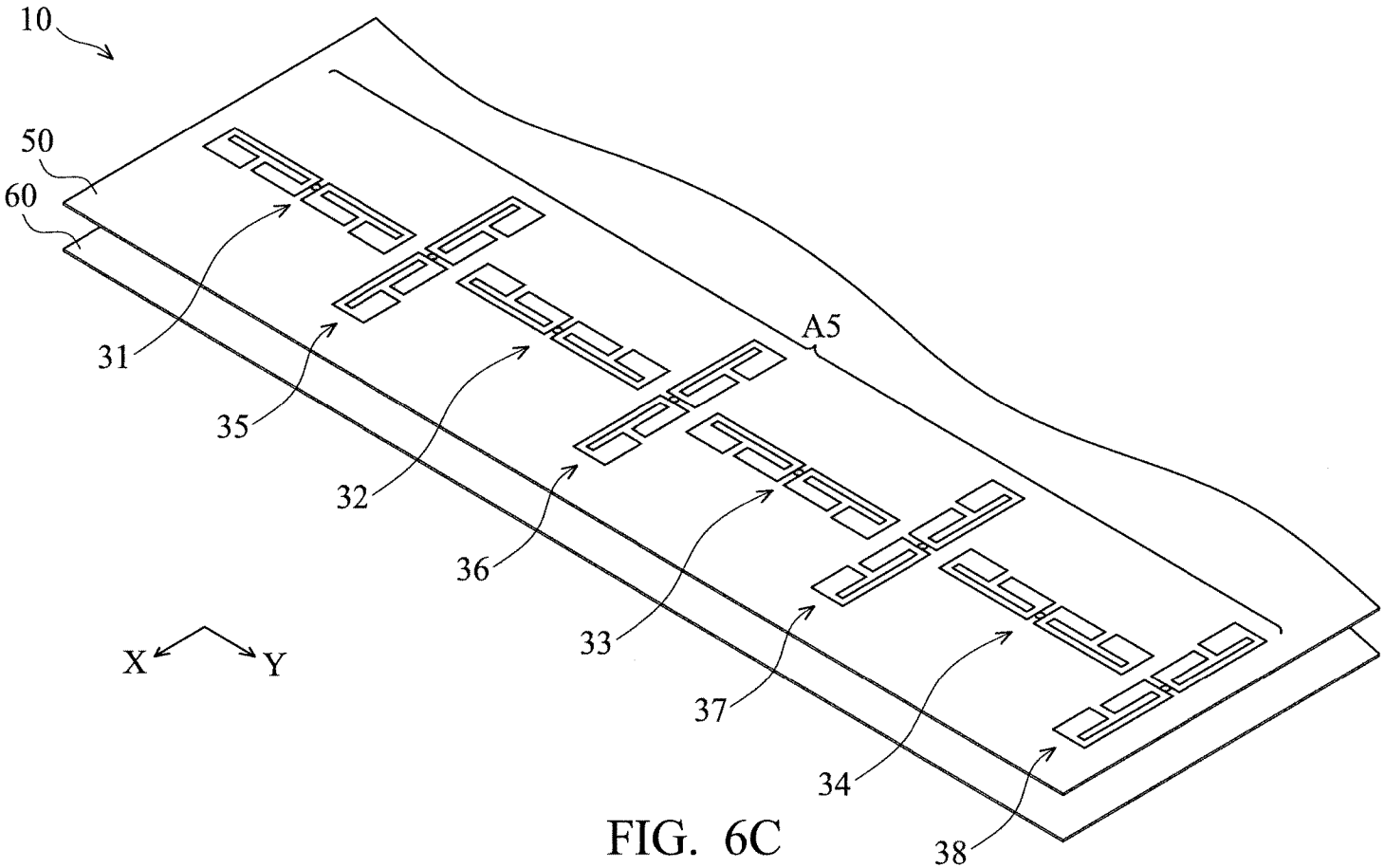
Figure 6D:
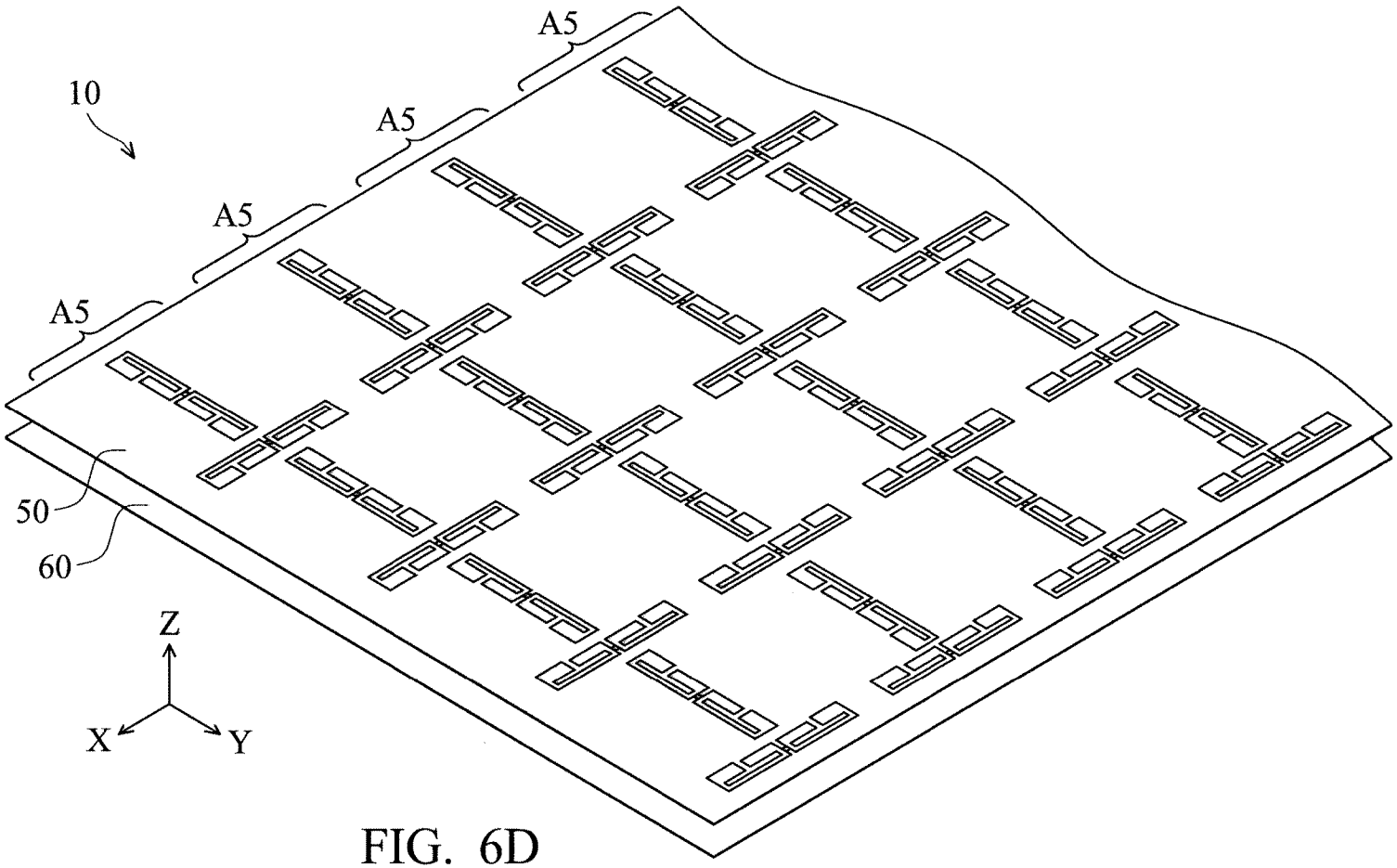

FIG. 6B is a schematic of the antenna device 10 according to an embodiment of the invention. The antenna device 10 includes an antenna array A4 arranged on the circuit board 50, and the antenna array A4 include four dipole antennas 35~38. The polarization directions of the dipole antennas 35~38 are parallel to X axis, and the notch directions of the dipole antennas 35 and 36 are toward the same direction as the Y axis, and the notch directions of the dipole antennas 37 and 38 are toward the direction opposite to the Y axis. FIG. 6C and FIG. 6D are schematics of antenna devices according to other embodiments of the invention. As shown in FIG. 6C, the antenna array A5 has eight dipole antennas 31~38. Regarding the dipole antennas 31~34 of Y-axis polarization direction, their dispositions of notches are interlaced. Regarding the dipole antennas 35~38 of X-axis polarization direction, their dispositions of notches are symmetrical. In other words, any two adjacent dipole antennas of the eight dipole antennas 31~38 have different polarization directions and/or have different notch directions. Therefore, dipole antenna of X-axis polarization direction or Y-axis polarization direction could be selected by the antenna device 10 according to user needs and the environment. Because the dipole antennas with the same polarization direction have different notch directions, a complete radiation pattern with wide lobe could be provided for the specific direction or plane (such as the auditorium of a large stadium). Furthermore, in the embodiment of FIG. 6D, the antenna device 10 includes four identical antenna arrays A5. Each antenna array A5 includes four dipole antennas 31, 32, 33 and 34 of Y-axis polarization direction, and four dipole antennas 35, 36, 37 and 38 of X-axis polarization direction. Four antenna arrays A5 are arranged along the X-axis direction. Therefore, the four antenna arrays A5 could be utilized for a 4×4 MIMO system.

Figure 7A:
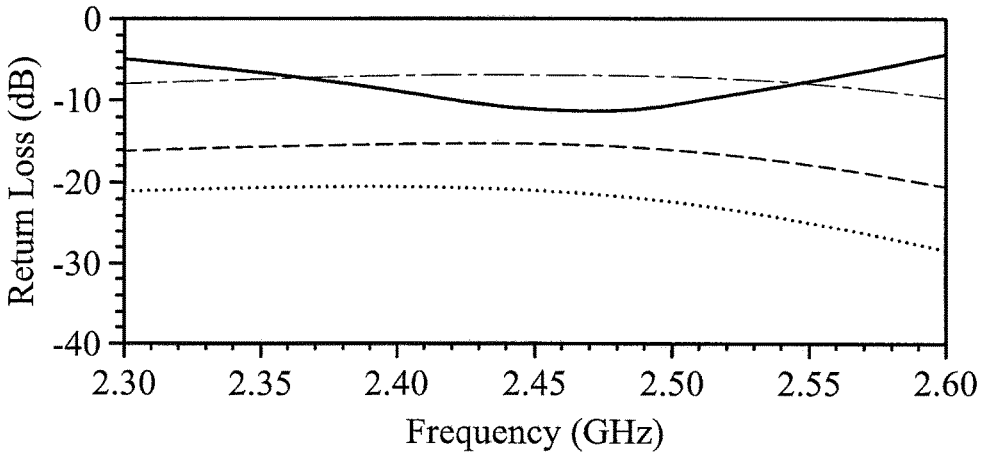
FIG. 7A is a simulation chart illustrating return loss of the dipole antenna in a first frequency according to an embodiment of the invention.
Figure 7B:
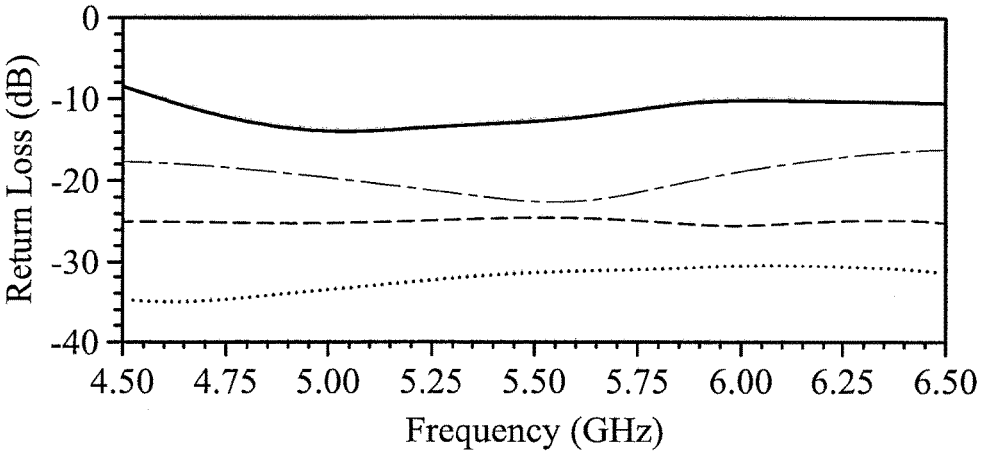
FIG. 7B is a simulation chart illustrating return loss of the dipole antenna in the second frequency according to an embodiment of the invention.

FIG. 7A and FIG. 7B are simulation charts illustrating return loss of the dipole antenna in a first frequency and a second frequency respectively according to embodiments of the invention. In the simulation charts, the solid lines indicate the return loss, and the dashed lines indicate the coupling coefficient. The return loss of the dipole antenna in the first frequency (2.4 GHz~2.5 GHz) is smaller than −8.86 dB, and the return loss of the dipole antenna in the second frequency (4.9 GHz~5.95 GHz) is smaller than −10.24 dB.

Figure 7C:
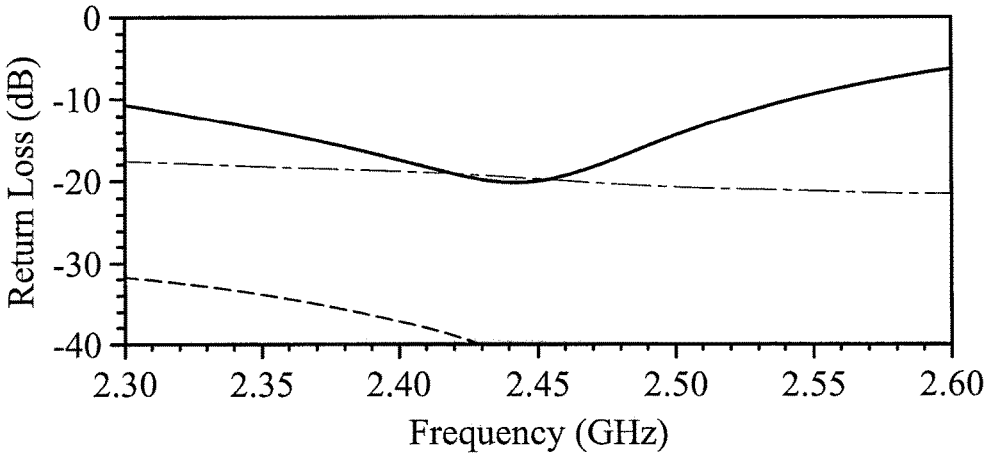
FIG. 7C is a simulation chart illustrating return loss of the dipole antenna in a first frequency according to an embodiment of the invention.
Figure 7D:
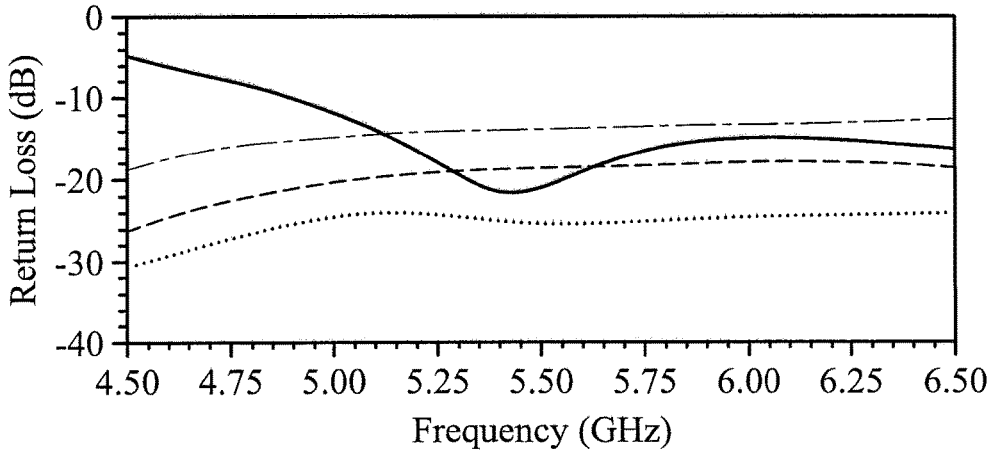
FIG. 7D is a simulation chart illustrating return loss of the dipole antenna in the second frequency according to an embodiment of the invention.

FIG. 7C and FIG. 7D are simulation charts illustrating return loss of the dipole antennas 35~38 in a first frequency and a second frequency respectively according to embodiments of the invention. As shown in the figures, the return loss of the dipole antenna in the first frequency is smaller than −14.57 dB, and the return loss of the dipole antenna in the second frequency is smaller than −10.91 dB. Therefore, the dipole antennas 31~38 of the present invention are suitable for wireless communication such as WiFi.

Figure 8A:
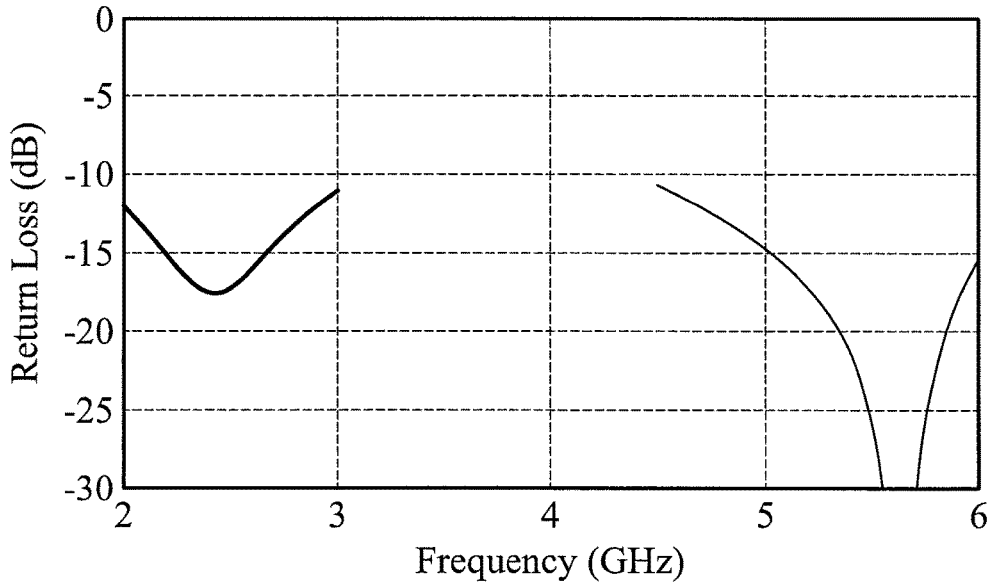
FIG. 8A is a simulation chart illustrating return loss of the switch device according to an embodiment of the invention.
Figure 8B:
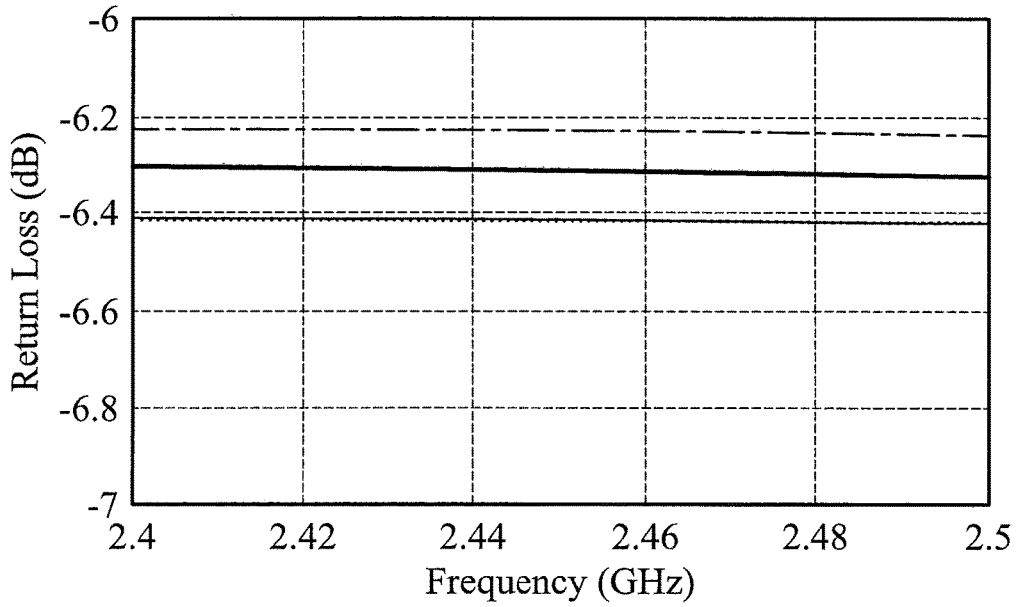
FIG. 8B is a simulation chart illustrating insertion loss of the switch device in a first frequency according to an embodiment of the invention.
Figure 8C:
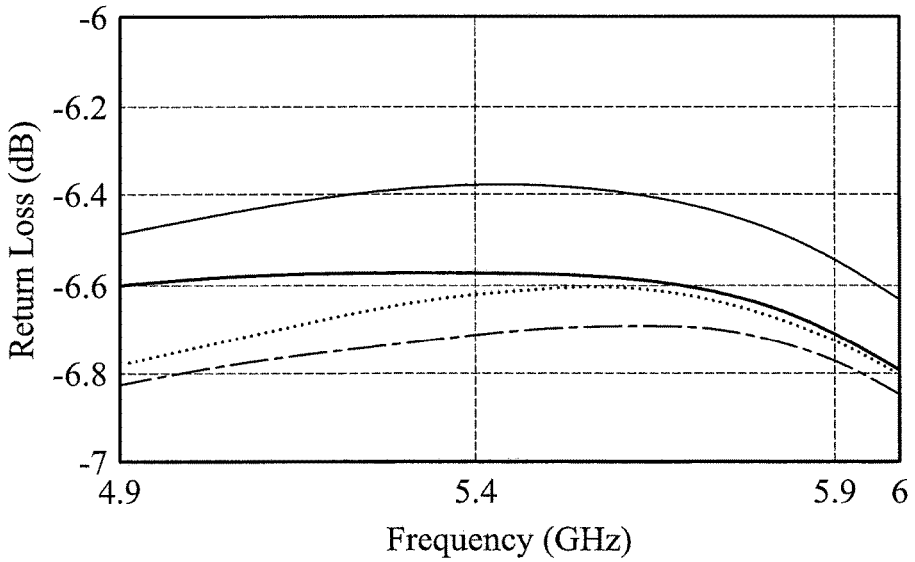
FIG. 8C is a simulation chart illustrating insertion loss of the switch device in the second frequency according to an embodiment of the invention.

FIG. 8A is a simulation chart illustrating return loss of the switch device 30 of FIG. 4B according to an embodiment of the invention. The return loss of the switch device 30 in the first frequency is smaller than −17.24 dB, and the return loss of the switch device 30 in the second frequency is smaller than −13.72 dB. FIG. 8B and FIG. 8C are simulation charts illustrating insertion loss of the switch device 30 of FIG. 4B in a first frequency and a second frequency respectively according to embodiments of the invention. Specifically, four lines illustrated in FIG. 8B and FIG. 8C indicates the insertion loss of the terminal PA with four terminals PB-PE for evaluating loss of signals between two terminals. The insertion loss of the switch device 30 in the first frequency is on the range of −6.226 dB~−6.422 dB, and the insertion loss of the switch device 30 in the second frequency is on the range of −6.48 d~−6.819 dB. Therefore, average RF power loss of the switch device 30 of the present invention in the first frequency and second frequency are 0.3 dB and 0.65 dB. The impedance measured in the terminal PA is about 50 ohm. Therefore, the antenna device 10 with the switch device 30 could provide good transmission features for RF signals.

Figure 9A:
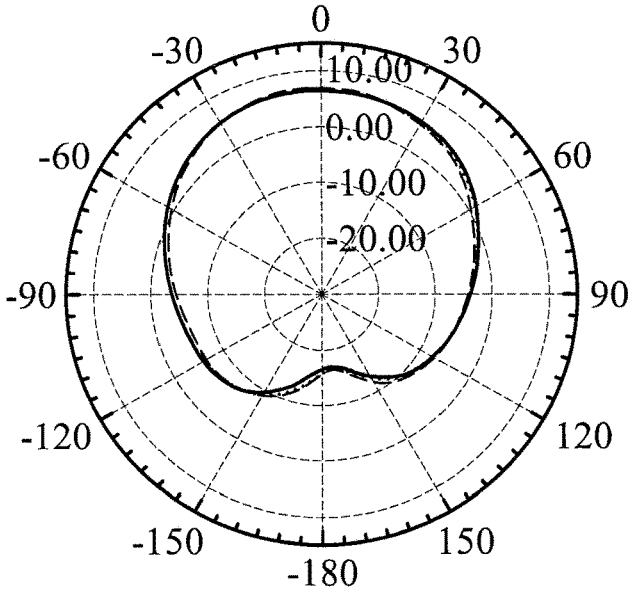
FIG. 9A and FIG. 9B are radiation patterns of the antenna device in the first frequency according to an embodiment of the invention.
Figure 9B:
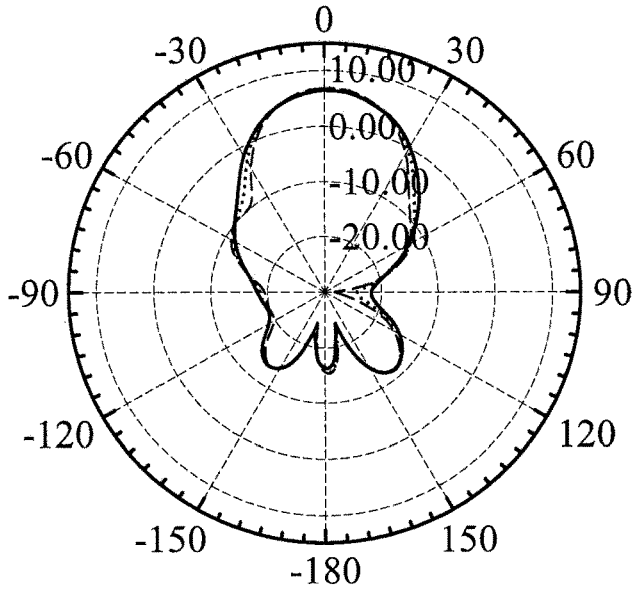
Figure 10A:
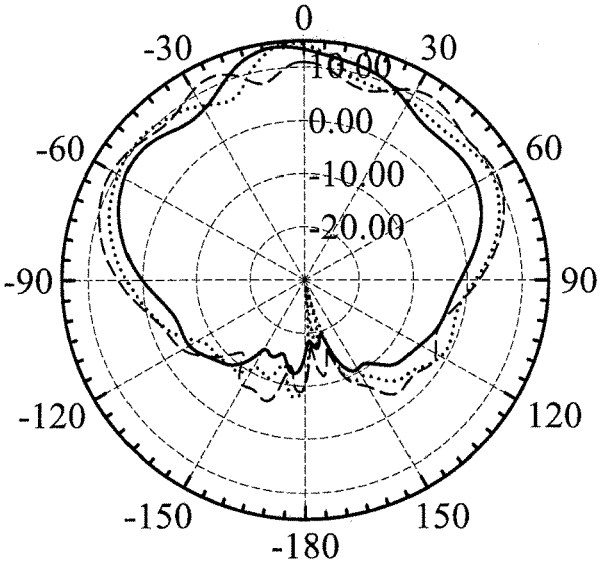
FIG. 10A and FIG. 10B are radiation patterns of the antenna device in the second frequency according to an embodiment of the invention.
Figure 10B:
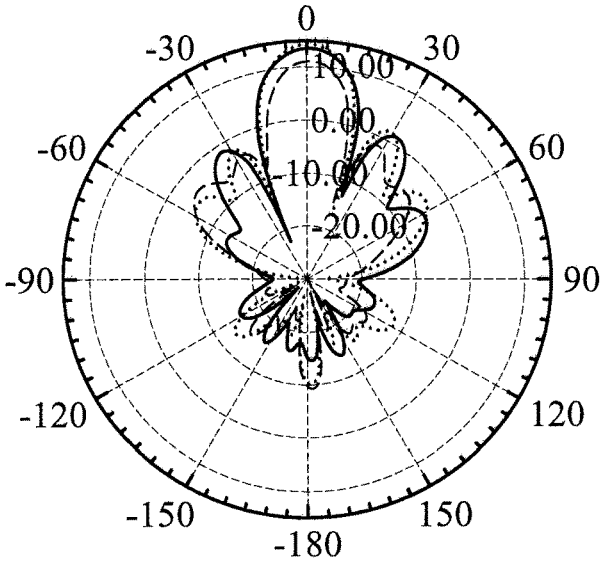

FIG. 9A and FIG. 9B are radiation patterns of the antenna devices 31~34 in the first frequency on the X-Z plane and Y-Z plane respectively according to an embodiment of the invention. Since the polarization direction of the dipole antennas 31~34 is Y-axis direction, in the radiation pattern of X-Z plane of FIG. 9A, the angle of radiation bandwidth with the antenna gain greater than 4 dBi is 86 degrees (from −41 degrees to 45 degrees), and the maximum gain in Y-axis direction is 6.8 dBi. FIG. 10A and FIG. 10B are radiation patterns of the antenna devices 31, 33, 35 and 37 in the second frequency on the X-Z plane and Y-Z plane respectively according to an embodiment of the invention. Since the polarization direction of the dipole antennas 31, 33, 35 and 37 is X-axis direction, in the radiation pattern of X-Z plane of FIG. 10A, the angle of radiation bandwidth with the antenna gain greater than 5 dBi is 143 degrees (from −75 degrees to 68 degrees), and the maximum gain in Y-axis direction is about 11.7 dBi~13.9 dBi. Therefore, the antenna array of Y-axis polarization direction of the present invention provides symmetrical radiation pattern and wide radiation bandwidth.

Figure 11A:
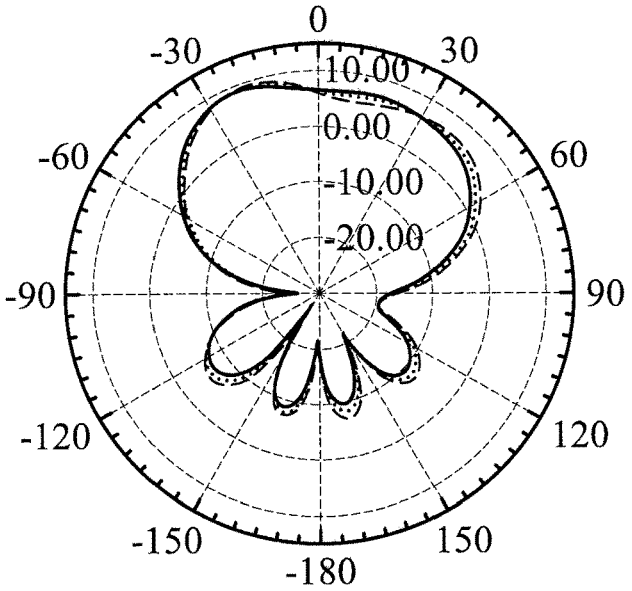
FIG. 11A and FIG. 11B are radiation patterns of the antenna device in the first frequency according to an embodiment of the invention.
Figure 11B:
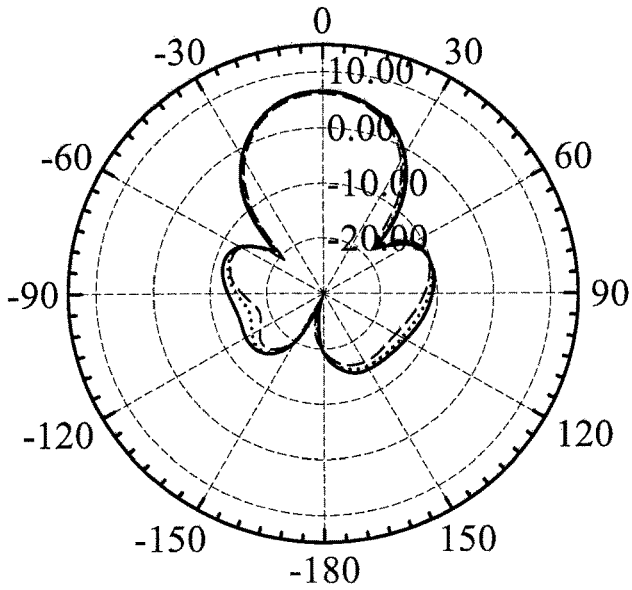
Figure 12A:
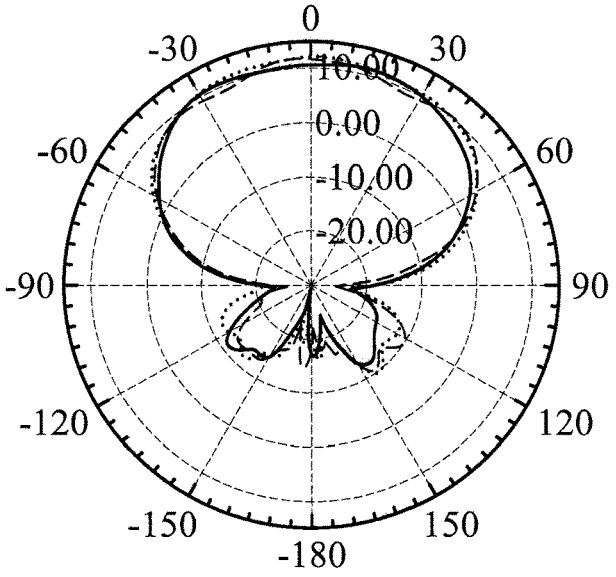
FIG. 12A and FIG. 12B are radiation patterns of the antenna device in the second frequency according to an embodiment of the invention.
Figure 12B:
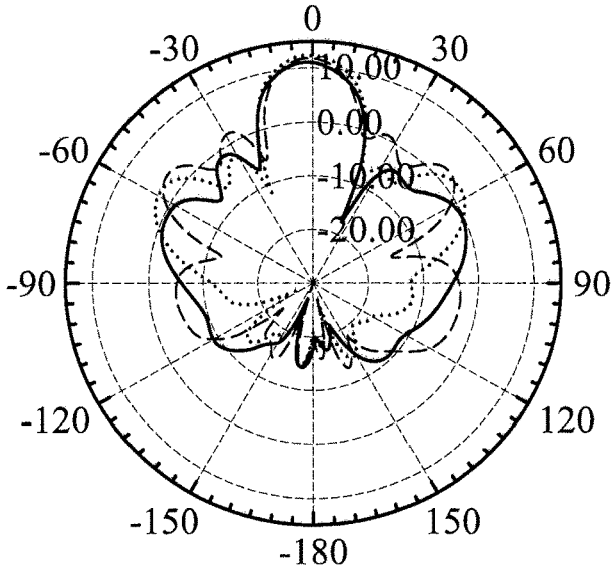

FIG. 11A and FIG. 11B are radiation patterns of the antenna devices 35~38 in the first frequency on the X-Z plane and Y-Z plane respectively according to an embodiment of the invention. Since the polarization direction of the dipole antennas 35~38 is X-axis direction, in the radiation pattern of X-Z plane of FIG. 11A, the angle of radiation bandwidth with the antenna gain greater than 4 dBi is 98 degrees (from −43 degrees to 53 degrees), and the maximum gain in X-axis direction is 9.45 dBi. FIG. 12A and FIG. 12B are radiation patterns of the antenna devices 35~38 in the second frequency on the X-Z plane and Y-Z plane respectively according to an embodiment of the invention. Since the polarization direction of the dipole antennas 35~38 is X-axis direction, in the radiation pattern of X-Z plane of FIG. 12A, the angle of radiation bandwidth with the antenna gain greater than 5 dBi is 106 degrees (from −52 degrees to 54 degrees), and the maximum gain in Y-axis direction is about 10.82 dBi~12.17 dBi. Therefore, the antenna array of X-axis polarization direction of the present invention provides a symmetrical radiation pattern and a wide radiation bandwidth.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna device, comprising:

a first dipole antenna, wherein polarization direction of the first dipole antenna is a first direction; and a second dipole antenna, wherein polarization direction of the second dipole antenna is the first direction, and each of the first dipole antenna and the second dipole antenna comprises two antenna structures, each of the antenna structures comprises a first radiator and a second radiator, a notch is arranged between the first radiator and the second radiator of each of the antenna structures, the notches of the first dipole antenna are toward a second direction, and the notches of the second dipole antenna are toward a third direction that is different from the second direction, wherein the first dipole antenna and the second dipole antenna are disposed on the same plane;

wherein the first radiator is arranged for implementing signals of a first frequency and the second radiator is arranged for implementing signals of a second frequency;

wherein the second frequency is different from the first frequency.

2. The antenna device as claimed in claim 1, wherein the first direction is vertical to the second direction, the first direction is vertical to the third direction, and the difference between the second direction and the third direction is 180 degrees.

3. The antenna device as claimed in claim 1, further comprising a switch device, wherein the first dipole antenna comprises a first feeding point, the second dipole antenna comprises a second feeding point, and the antenna device connects with the switch device through the first feeding point and the second feeding point enable the first dipole antenna and the second dipole antenna.

4. The antenna device as claimed in claim 1, further comprising a third dipole antenna and a fourth antenna whose structures are the same as the first dipole antenna and the second dipole antenna, wherein polarization directions of the third dipole antenna and the fourth dipole antenna are the first direction, the first dipole antenna is arranged between the third dipole antenna and the second dipole antenna, notch of the third dipole antenna is toward the second direction or the third direction, the second dipole antenna is arranged between the first dipole antenna and the fourth dipole antenna, and notch of the fourth dipole antenna is toward the second direction or the third direction.

5. An antenna device, comprising:

at least one antenna array, wherein each of the antenna array comprises:

a first dipole antenna, wherein polarization direction of the first dipole antenna is a first direction;

a second dipole antenna, wherein polarization direction of the second dipole antenna is a second direction;

a third dipole antenna, wherein polarization direction of the third dipole antenna is the first direction;

a fourth dipole antenna, wherein polarization direction of the fourth dipole antenna is the second direction, each of the first dipole antenna, the second dipole antenna, the third dipole antenna and the fourth dipole antenna comprises two antenna structures, and each antenna structure comprises a first radiator for implementing signals of a first frequency and a second radiator for implementing signals of a second frequency, wherein a notch is arranged between the first radiator and the second radiator of each of the antenna structures, notch direction of the first dipole antenna is different from notch direction of the third dipole antenna, and notch direction of the second dipole antenna is different from notch direction of the fourth dipole antenna, wherein the first dipole antenna, the second dipole antenna, the third dipole antenna, and the fourth dipole antenna are disposed on the same plane.

6. The antenna device as claimed in claim 5, wherein the second dipole antenna is arranged between the first dipole antenna and the third dipole antenna, and the third dipole antenna is arranged between the second dipole antenna and the fourth dipole antenna.

7. The antenna device as claimed in claim 5, wherein the first direction is vertical to the second direction, and the first dipole antenna, the second dipole antenna, the third dipole antenna and the fourth dipole antenna are arranged along the first direction.

8. The antenna device as claimed in claim 7, wherein the at least one antenna array comprises two identical antenna arrays, and the two antenna arrays are arranged along the second direction.

9. The antenna device as claimed in claim 7, wherein each of the antenna array comprises a fifth dipole antenna and a sixth dipole antenna whose structures are the same as the first dipole antenna, the second dipole antenna, the third dipole antenna and the fourth dipole antenna, polarization directions of the fifth dipole antenna and the sixth dipole antenna are the first direction and the second direction respectively, the first dipole antenna is arranged between the sixth dipole antenna and the second dipole antenna, and the sixth dipole antenna is arranged between the first dipole antenna and the fifth dipole antenna.

10. The antenna device as claimed in claim 9, wherein each of the antenna array comprises a seventh dipole antenna and a eighth dipole antenna whose structures are the same as the first dipole antenna, the second dipole antenna, the third dipole antenna and the fourth dipole antenna, polarization directions of the seventh dipole antenna and the eighth dipole antenna are the first direction and the second direction respectively, the fourth dipole antenna is arranged between the seventh dipole antenna and the third dipole antenna, and the seventh dipole antenna is arranged between the fourth dipole antenna and the eighth dipole antenna.

11. The antenna device as claimed in claim 10, wherein the first dipole antenna comprises a first feeding point, the third dipole antenna comprises a third feeding point, the fifth dipole antenna comprises a fifth feeding point, the seventh dipole antenna comprises a seventh feeding point, and the antenna device connects with a switch device through the first feeding point, the third feeding point, the fifth feeding point and the seventh feeding point to enable the first dipole antenna, the third dipole antenna, the fifth dipole antenna and the seventh dipole antenna.

12. The antenna device as claimed in claim 10, wherein the second dipole antenna comprises a second feeding point, the fourth dipole antenna comprises a fourth feeding point, the sixth dipole antenna comprises a sixth feeding point, the eighth dipole antenna comprises a eighth feeding point, and the antenna device connects with the switch device through the second feeding point, the fourth feeding point, the sixth feeding point and the eighth feeding point to enable the second dipole antenna, the fourth dipole antenna, the sixth dipole antenna and the eighth dipole antenna.

13. The antenna device as claimed in claim 10, wherein the at least one antenna array comprises four identical antenna arrays, and the four antenna arrays are arranged along the second direction.

14. The antenna device as claimed in claim 7, wherein difference between notch direction of the first dipole antenna and notch direction of the third dipole antenna is 180 degrees, notch direction of the first dipole antenna is vertical to the first direction, difference between notch direction of the second dipole antenna and notch direction of the fourth dipole antenna is 180 degrees, notch direction of the second dipole antenna is vertical to the second direction.

15. The antenna device as claimed in claim 5, further comprising a switch device for enabling the first dipole antenna and the third dipole antenna whose polarization directions are the first direction of the antenna device, or enabling the second dipole antenna and the fourth dipole antenna whose polarization directions are the second direction of the antenna device.

16. The antenna device as claimed in claim 5, further comprising a switch device, wherein the first dipole antenna comprises a first feeding point, the second dipole antenna comprises a second feeding point, the third dipole antenna comprises a third feeding point, the fourth dipole antenna comprises a fourth feeding point, and the switch device connects with the first feeding point, the second feeding point, the third feeding point and the fourth feeding point.

17. The antenna device as claimed in claim 16, wherein the switch device is utilized to enable the first dipole antenna, the second dipole antenna, the third dipole antenna and the fourth dipole antenna, a first terminal of the switch device connects with a RF (radio frequency) device, a second terminal, a third terminal, a fourth terminal and a fifth terminal of the switch device connect with the first feeding point, the second feeding point, the third feeding point and the fourth feeding point to implement signal transmission between the antenna device and the RF device, and the first dipole antenna and the third dipole antenna operate in a first frequency, and the second dipole antenna and the fourth dipole antenna operate in a second frequency.

* * * * *